United States Patent [19]

Ireland

[11] Patent Number: 5,046,253

[45] Date of Patent: Sep. 10, 1991

[54] KNIVES

[76] Inventor: William A. Ireland, 257 Pirton Lane, Churchdown, Gloucestershire GL3 2QJ, England

[21] Appl. No.: 508,462

[22] Filed: Apr. 13, 1990

Related U.S. Application Data

[63] Continuation of Ser. No. 299,634, Jan. 23, 1989, abandoned.

[30] Foreign Application Priority Data

Mar. 30, 1988 [GB] United Kingdom ..... 8807577

[51] Int. Cl.[5] ..... B26B 3/00

[52] U.S. Cl. ..... 30/289; 30/294; 30/314

[58] Field of Search ..... 30/294, 290, 314, 317, 30/329, 291, 288, 286, 287, 289; 83/440, 443, 449, 450, 856–858

[56] References Cited

U.S. PATENT DOCUMENTS

| | | | |
|---|---|---|---|
| 419,271 | 1/1890 | Low | 30/289 |
| 740,339 | 9/1903 | Tumelty | 30/290 |
| 1,402,061 | 1/1922 | Fleece | 30/289 |
| 2,254,199 | 9/1941 | Baltuch | 30/289 |
| 2,312,143 | 2/1943 | Atkins | 30/290 |
| 2,599,439 | 6/1952 | Drake | 30/287 |
| 2,688,187 | 9/1954 | Pauli | 30/289 |
| 2,810,194 | 10/1957 | Unsinger | 30/294 X |
| 3,613,241 | 10/1971 | Allen | 30/294 |
| 3,751,806 | 8/1973 | Patrick | 30/294 |
| 3,824,688 | 7/1974 | Goffe | 30/294 |
| 3,918,157 | 11/1975 | Hyba | 30/289 X |

*Primary Examiner*—Hien H. Phan
*Assistant Examiner*—Rinaldi Rada
*Attorney, Agent, or Firm*—Young & Thompson

[57] ABSTRACT

A safety knife comprises a handle formed with an elongate narrow slot which extends transversely completely through the handle from one lateral surface thereof to the other, and extends lengthwise from a slot mouth in an outer surface of the handle to a location within the handle. The handle is formed in two halves which are clamped together by bolts, and sandwiched between the two halves is a blade having a cutting edge which extends at an acute angle across the width of the slot at a location spaced inwardly from its mouth. In use, string or similar material to be cut is passed along the slot until it meets the cutting edge of the blade, and continued pressure of the blade on the string then severs the string. Since the cutting edge is encased within the handle and is spaced from the mouth of the slot, there is little or no risk of the user being accidentally cut by the blade.

5 Claims, 1 Drawing Sheet

KNIVES

This application is a continuation of application No. 299,634, filed Jan. 23, 1989 now abandoned.

BACKGROUND OF THE INVENTION

The invention relates to knives and sets out to provide a safety knife where there is little or no risk of accidental injury to the user of the knife.

Most conventional knives have a blade which is entirely exposed when the knife is in use, and the blade is covered to avoid accidental injury only when the knife is out of use. For example, a sheath knife, when not required for use, has its blade encased in a separate sheath, whereas the blade of a pocket knife can usually be folded so that at least the cutting edge of the blade is received in a slot in the knife handle.

While such knives are comparatively safe when out of use, they can result in accidental injury or damage when being used for cutting, or when being held in readiness for such use, since the blade is exposed. The present invention, however, provides a form of knife where the cutting edge of the blade is protected by the knife handle at all times, thus rendering the knife particularly safe. The knife according to the invention may be less versatile than a conventional knife having a fully exposed blade, but it is particularly suitable for some forms of cutting operation, for example for cutting lengths of string or the like.

SUMMARY OF THE INVENTION

According to the invention there is provided a knife comprising a handle formed with an elongate narrow slot which extends transversely completely through the handle from one lateral surface thereof to the other, and which extends lengthwise from a slot mouth in an outer surface of the handle to a location within the handle, there being encased within the handle a blade having a cutting edge which extends across the width of the slot at a location spaced inwardly from the mouth of the slot.

In use, the string or similar material to be cut is passed along the slot until it meets the cutting edge of the blade, and continued pressure of the blade on the string then severs the string. However, since the cutting edge is encased within the handle and is spaced from the mouth of the slot, there is little or no risk of any part of the cutting edge accidentally coming into engagement with any part of the user's body. The risk may be reduced by reducing the width of the slot. Thus, if the width of the slot is less than the thickness of a human finger the risk of accidental injury by the knife is virtually nil.

Preferably the cutting edge of the blade extends at an angle to the length of the slot so as to form an acute angle with one of the surfaces defining the sides of the slot. Then, as the string or similar element passes along the slot it becomes wedged into the acute angle and is pressed against the cutting edge. Preferably the surface forming an acute angle with the cutting edge is formed with a longitudinal groove into which the cutting edge of the blade partly extends. The opposite face of the slot may be of complementary shape to the grooved face, so that the slot is generally V-shaped as viewed in cross section.

Preferably the handle is elongate, the slot extending both transversely and longitudinally into the handle from one longitudinal side edge thereof. For example, the slot may be curved as it extends inwardly and longitudinally of the handle.

Preferably the handle is formed in two parts having means for clamping the two parts together with the blade sandwiched between them. One or both of the interengaging faces of the two parts of the handle may be formed with a recess to receive the blade.

The means for clamping the two parts of the handle together may also be engageable with part of the blade so as to assist in securing the blade between the two parts of their handle. For example, the two parts of the handle and the blade may be formed with registering holes through which a clamping device may pass. Preferably the clamping device is a disengageable device, such as a nut and bolt, so that the two parts of the handle may be separated, if required, to replace the blade.

DETAILED DESCRIPTION OF THE PREFERRED EMBODIMENT

Figure 1:
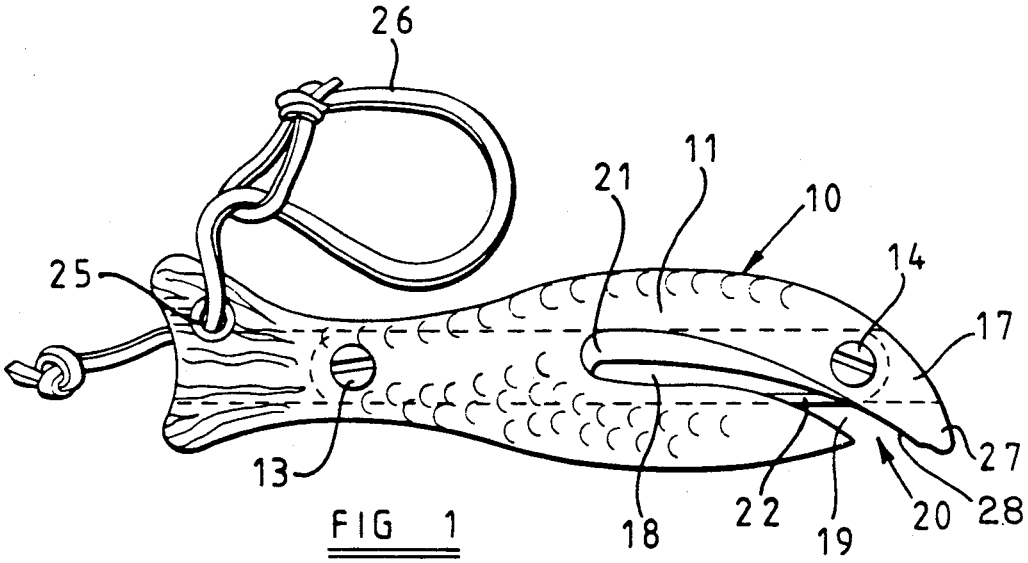
FIG. 1 is a side elevation of a safety knife in accordance with the invention.
Figure 2:
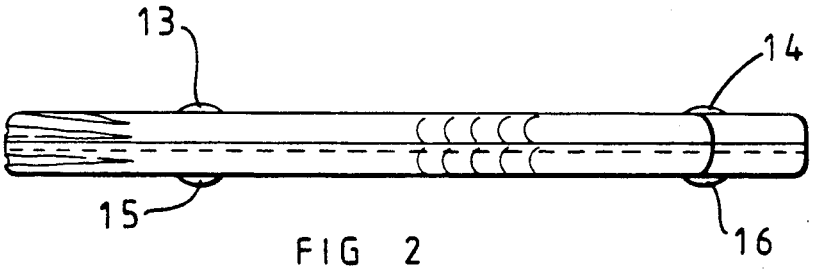
FIG. 2 is a view of the underside of the knife and, FIG. 3 is the end view of the knife.

The knife includes a handle 10. As will be seen from FIG. 1 the handle is generally in the shape of a stylised fish. It happens that this provides a particularly attractive appearance for the knife but the shape illustrated is primarily selected because it sits comfortably in the hand when the knife is in use, and its basic resemblance to the shape of a fish is incidental.

The handle 10 is formed from two parts 11 and 12 clamped together by means of two bolts 13 and 14 which pass through registering holes in the two parts of the handle and the threaded ends of which are engaged by circular nuts 15, 16 respectively.

The flat face of one of the parts 12 of the handle is formed along its length with an elongate shallow recess 17 which receives a steel cutting blade 18. The cutting blade 18 is shorter than the handle and is formed with rounded ends. The blade is also formed with two holes which register with the holes in the side parts of the handle so that the screws 13 and 14 also pass through the holes in the blade 18.

The two side parts of the handle are each formed with similar curved slots which register with one another to form a single narrow curved slot 19 which extends completely through the handle from on lateral surface thereof to the other. The slot 19 extends from its mouth 20 in the underside edge of the handle, adjacent one end, inwardly and longitudinally of the handle to its closed end 21. One side of the slot 19, adjacent the mouth 20 thereof, is defined by a longitudinal surface 28 of a tapered tip portion 27 of the handle which, as shown, points generally longitudinally away from the rest of the handle 10 at one end. The slot is so located that the cutting edge 22 of the blade 18 extends across the width of the slot 19 at an obtuse angle to the surface 28, so as to form generally a continuation thereof, at a distance from the mouth 20 of the slot.

Figure 3:
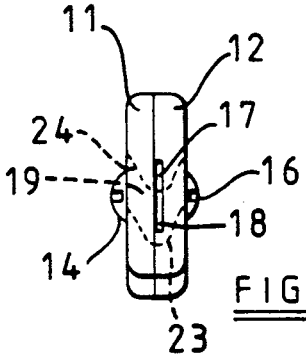

As best seen in FIG. 3, the surfaces of the parts of the handle which form the underside of the slot 19 cooperate to form a groove 23, the cutting edge of the blade 18 projecting partly into the groove 23. As shown in FIG. 3, the groove 23 has a width greater than the thickness of the blade 18. The surfaces 28 defining the upper surface of the slot are shaped in a complementary fashion to the groove 23, as indicated at 24, so that, as best seen in FIG. 3, the slot 19 is generally V-shaped in cross section.

At one end of the knife handle 10 there is formed a hole 25, which may be reinforced with a metal bush, through which may pass a looped thong or cord 26 so that the knife may hang from the user's wrist.

In order to cut string or some similar element with the knife, the knife is pushed over the string so that the string enters the mouth of the slot 20, passes along the slot and becomes wedged against the cutting edge 22 of the blade 18 and is thus severed. The V-shaped cross section of the slot 19 forms a bend in the string which assists in the cutting action as the string bears against the blade. The knife may conveniently be used, for example, for cutting string which is bound around parcels or bales, the string being passed into the slot by inverting the knife, introducing the tip portion 27 of the handle beneath the string and pushing forwardly so that the string passes along the slot.

It will be seen that, when the knife is not in use, it is virtually impossible for any injury or damage to be caused by inadvertent contact with the cutting edge 22 of the knife blade, since access to the cutting edge can only be obtained through the narrow slot 19, which is preferably too narrow for a normal finger to be inserted. Accordingly, the knife is always ready for use and, when not required for use, can dangle safely from the user's wrist without having to be rendered safe, as in the case with a conventional sheath knife or pocket knife.

When the portion of the knife blade extending across the slot 19 becomes blunt, it may be renewed by separating the two halves of the handle and reversing the blade to bring another, fresh portion thereof across the slot 19. When the blade becomes blunted in all usable portions, it may easily be replaced in similar fashion.

The two parts of the handle 10 may be formed from any suitable material, for example they may be carved from wood. However, for cheapness of manufacture, the two parts of the handle may conveniently be moulded from a plastics material using conventional moulding techniques. Alternatively, for a particularly strong knife the parts of the handle may be cast or otherwise fabricated from metal.

For added decorative effect the surface of the handle may be moulded or otherwise configured with a representation of the scales of a fish, plain spaces being left, if required, for the application of advertising or other literary material.

The particular configuration of the knife shown in the drawings is by way of example only, and it will be appreciated that other shapes of handle and slot may be employed, provided that the arrangement is still such that access to the cutting edge of the blade is prevented by locating the blade within the handle and permitting access thereto only through a narrow slot.

I claim:

1. A knife comprising an elongate handle formed with an elongate narrow slot which extends transversely completely through the handle from one lateral surface thereof to the other, and which extends lengthwise of the handle from a slot mouth in an outer surface of the handle, adjacent one extremity thereof, to a location within the handle, therebeing encased within the handle a blade having an exposed operative cutting edge which extends across the slot at a location spaced inwardly from the mouth of the slot, one side of the slot, adjacent the mouth thereof, being defined by a longitudinal surface of a tapered tip portion of the handle which points generally longitudinally away from the rest of the handle at said one extremity thereof, the exposed operative cutting edge of the blade extending at an obtuse angle to said longitudinal surface of the tapered tip portion so as to form generally a continuation thereof, and the slot having a surface, opposite said longitudinal surface of the tapered tip portion, forming an acute angle with the exposed operative cutting edge of the blade, which surface is formed with a longitudinal groove which is wider than the thickness of the blade and into which the operative cutting edge of the blade partly extends at said acute angle, the handle being formed in two parts having means for clamping the two parts together with the blade sandwiched between them, said means for clamping the two parts of the handle together being also engageable with part of the blade so as to assist in securing the blade between the two parts of the handle.

2. A knife according to claim 1, wherein the two parts of the handle and the blade are formed with registering holes through which a clamping device passes.

3. A knife according to claim 2, wherein the clamping device is a disengageable device, so that the two parts of the handle may be separated, if required, to replace the blade.

4. A knife comprising an elongate handle formed with an elongate narrow slot which extends transversely completely through the handle from one lateral surface thereof to the other, and which extends lengthwise of the handle from a slot mouth in an outer surface of the handle, adjacent one extremity thereof, to a location within the handle, there being encased within the handle a blade having an exposed operative cutting edge which extends across the slot at a location spaced inwardly from the mouth of the slot, one side of the slot, adjacent the mouth thereof, being defined by a longitudinal surface of a tapered tip portion of the handle which points generally longitudinally away from the rest of the handle at said one extremity thereof, the exposed operative cutting edge of the blade extending at an obtuse angle to said longitudinal surface of the tapered tip portion so as to form generally a continuation thereof, and the slot having a surface, opposite said longitudinal surface of the tapered tip portion, forming an acute angle with the exposed operative cutting edge of the blade, which surface is formed with a longitudinal groove which is wider than the thickness of the blade and into which the operative cutting edge of the blade partly extends at said acute angle, said slot being generally V-shaped as viewed in cross section.

5. A knife comprising an elongate handle formed with an elongate narrow slot which extends transversely completely through the handle from one lateral surface thereof to the other, and which extends lengthwise of the handle from a slot mouth in an outer surface of the handle, adjacent one extremity thereof, to a location within the handle, there being encased within the handle a blade having an exposed operative cutting edge which extends across the slot at a location spaced inwardly from the mouth of the slot, one side of the slot, adjacent the mouth thereof, being defined by a longitudinal surface of a tapered tip portion of the handle which points generally longitudinally away from the rest of the handle at said one extremity thereof, the exposed operative cutting edge of the blade extending at an obtuse angle to said longitudinal surface of the tapered tip portion so as to form generally a continuation thereof, and the slot having a surface, opposite said longitudinal surface of the tapered tip portion, forming an acute angle with the exposed operative cutting edge of the blade, which surface is formed with a longitudinal groove into which the operative cutting edge of the blade partly extends at said acute angle, the longitudinal groove being an open groove which is wider than the thickness of the blade whereby a space is provided on each side of a part of the blade which extends into said groove.

* * * * *